US009647393B2

(12) United States Patent
Tsai et al.

(10) Patent No.: US 9,647,393 B2
(45) Date of Patent: May 9, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Yang-Yang Zhou, New Taipei (TW); Long-Fei Chen, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/137,367

(22) Filed: Apr. 25, 2016

(65) Prior Publication Data

US 2016/0315424 A1 Oct. 27, 2016

(30) Foreign Application Priority Data

Apr. 24, 2015 (CN) ..... 2015 1 0197817

(51) Int. Cl.

| | |
|---|---|
| ***H01R 13/648*** | (2006.01) |
| ***H01R 13/6581*** | (2011.01) |
| ***H01R 13/6582*** | (2011.01) |
| ***H01R 13/6585*** | (2011.01) |
| ***H01R 24/62*** | (2011.01) |
| *H01R 13/506* | (2006.01) |
| *H01R 107/00* | (2006.01) |
| *H01R 24/60* | (2011.01) |
| *H01R 13/6594* | (2011.01) |

(52) U.S. Cl.
CPC ..... *H01R 13/6581* (2013.01); *H01R 13/6582* (2013.01); *H01R 13/6585* (2013.01); *H01R 24/62* (2013.01); *H01R 13/506* (2013.01); *H01R 13/6594* (2013.01); *H01R 24/60* (2013.01); *H01R 2107/00* (2013.01)

(58) Field of Classification Search
None
See application file for complete search history.

(56) References Cited

U.S. PATENT DOCUMENTS

| | | | | |
|---|---|---|---|---|
| 2015/0244111 | A1* | 8/2015 | Ju | H01R 13/6585 439/607.05 |
| 2015/0311645 | A1* | 10/2015 | Chang | H01R 13/6594 439/607.28 |
| 2016/0099524 | A1* | 4/2016 | Hack | H01R 13/6583 439/607.55 |

* cited by examiner

*Primary Examiner* — Tho D Ta
(74) *Attorney, Agent, or Firm* — Muncy, Geissler, Olds & Lowe, P.C.

(57) ABSTRACT

An electrical receptacle connector includes a metallic shell, an insulated housing, a plurality of first receptacle terminals, a plurality of second receptacle terminals, and a terminal organizer. The insulated housing is received in the metallic shell. The first receptacle terminals and the second receptacle terminals are respectively held at the top and the bottom of the insulated housing. The first receptacle terminals are longer than the second receptacle terminals. In assembly, the first receptacle terminals, of bar shape, are firstly processed with the terminal organizer. And then, the first receptacle terminals and the terminal organizer are assembled on the base portion and the tongue portion. Hence, the insert-molding procedure would not be affected by the first receptacle terminals with longer length.

12 Claims, 11 Drawing Sheets

100

| | | | | | | | | | | | | |
|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 6

ELECTRICAL RECEPTACLE CONNECTOR

CROSS-REFERENCES TO RELATED APPLICATIONS

This non-provisional application claims priority under 35 U.S.C. §119(a) on Patent Application No. 201510197817.7 filed in China, P.R.C. on Apr. 24, 2015, the entire contents of which are hereby incorporated by reference.

FIELD OF THE INVENTION

The instant disclosure relates to an electrical connector, and more particular to an elevated electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes flat terminals, a plastic core, and a tongue in front of the plastic core. In addition, the conventional USB type-C electrical receptacle connector further has an outer iron shell enclosing out of the plastic core.

In order to meet requirements for different products, a conventional elevated USB electrical receptacle connector includes an elevated plastic core formed with a plurality of terminals which are bent into L-shaped. The lengths of the terminals of the elevated USB electrical receptacle connector are longer than the lengths of the terminals of a normal USB electrical receptacle connector. As a result, because of the long lengths of the terminals, the terminals cannot be positioned with the mold stably during the insert molding for plastic core and terminals. Consequently, after the plastic core and the terminals are insert-molded, the terminals would be shifted easily, and the distances between the terminals would not be the same.

SUMMARY OF THE INVENTION

Accordingly, how to improve the existing connector becomes an issue.

In view of this, an embodiment of the instant disclosure provides an electrical receptacle connector. The electrical receptacle connector comprises a metallic shell, an insulated housing, a plurality of first receptacle terminals, a plurality of second receptacle terminals, and a terminal organizer. The metallic shell defines a receiving cavity therein. The insulated housing is received in the receiving cavity. The insulated housing comprises a base portion, a tongue portion, a plurality of extending portions, and an assembling region. The tongue portion is extending from one side of the base portion. The tongue portion has a first surface (i.e., upper surface) and a second surface (i.e., lower surface) opposite to the first surface. The extending portions are extending outward from the bottom of the base portion. The assembling region is defined between the extending portions. The first receptacle terminals comprise a plurality of first signal terminals, at least one power terminal, and at least one ground terminal. Each of the first receptacle terminals is held in the insulated housing and disposed at the first surface. Each of the first receptacle terminals comprises a flat contact portion, a body portion, and a tail portion. The body portion is held in the base portion and disposed at the first surface of the tongue portion. The flat contact portion is extending forward from the body portion in the rear-to-front direction and partly exposed upon the first surface of the tongue portion. The tail portion is extending backward from the body portion in the front-to-rear direction, and the tail portion is bent and further extending toward the assembling region. The second receptacle terminals comprise a plurality of second signal terminals, at least one power terminal, and at least one ground terminal. Each of the second receptacle terminals is held in the insulated housing and disposed at the second surface. Each of the second receptacle terminals comprises a flat contact portion, a body portion, and a tail portion. The body is held in the base portion and disposed at the second surface of the tongue portion. The flat contact portion is extending forward from the body portion in the rear-to-front direction and partly exposed upon the second surface of the tongue portion. The tail portion is extending backward from the body portion in the front-to-rear direction, and the tail portion is bent and further extending toward the assembling region. The terminal organizer is formed with the tail portions of the first receptacle terminals. The terminal organizer is located in the assembling region and two sides of the terminal organizer are positioned with the extending portions.

Based on the above, an elevated electrical receptacle connector is provided. The length of each of the first receptacle terminals is longer than that of a conventional receptacle terminal. Hence, because of the bar shaped appearances of the first receptacle terminals, the first receptacle terminals are firstly formed with the terminal organizer, and then the first receptacle terminals and the terminal organizer are assembled on the base portion and the tongue portion. Accordingly, the first receptacle terminals can be positioned and protected by the terminal organizer, and the longer length of each of the first receptacle terminals would not affect the insert-molding procedure.

In addition, the terminal organizer can position the tail portions of the first receptacle terminals. Hence, when a bending procedure is applied to the first receptacle terminals, the first receptacle terminals can be bent conveniently. Therefore, the angle defined by the flat contact portion and the tail portion of the first receptacle terminal can be adjusted to allow the first receptacle terminal to be firmly soldered with the circuit board. Moreover, the terminal organizer also improves the accessibility in bending the tail portions of the first receptacle terminals.

Furthermore, the extending body portion of the second terminal fixing base covers the tail portions of the second receptacle terminals, and the shielding sheet covers the front lateral surface of the extending body portion. Hence, the high frequency performance of the tail portions of the second receptacle terminals in the extending body portion can be enhanced by the shielding sheet. In addition, the openable and closeable rear cover plate allows the operator to check if the tail portions of the first receptacle terminals are firmly soldered with the contacts of the circuit board, and the rear cover plate can be closed after the soldering condition between the first receptacle terminals and the circuit board is checked. Once the soldering fails, the operator can redo the soldering procedure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 6 illustrates a schematic configuration diagram of the receptacle terminals of the electrical receptacle connector shown in FIG. 5;

DETAILED DESCRIPTION

Figure 1:
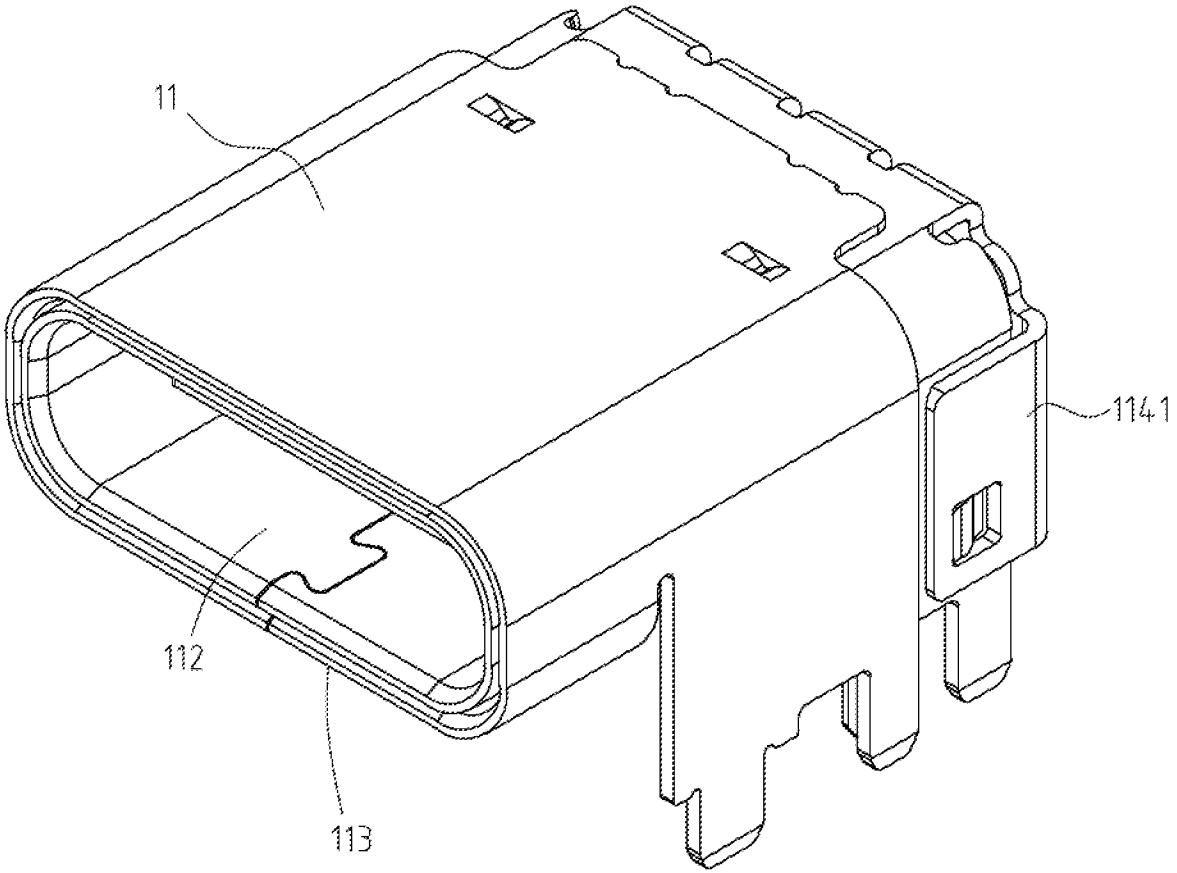
FIG. 1 illustrates a perspective view of an electrical receptacle connector according to an exemplary embodiment of the instant disclosure.
Figure 2:
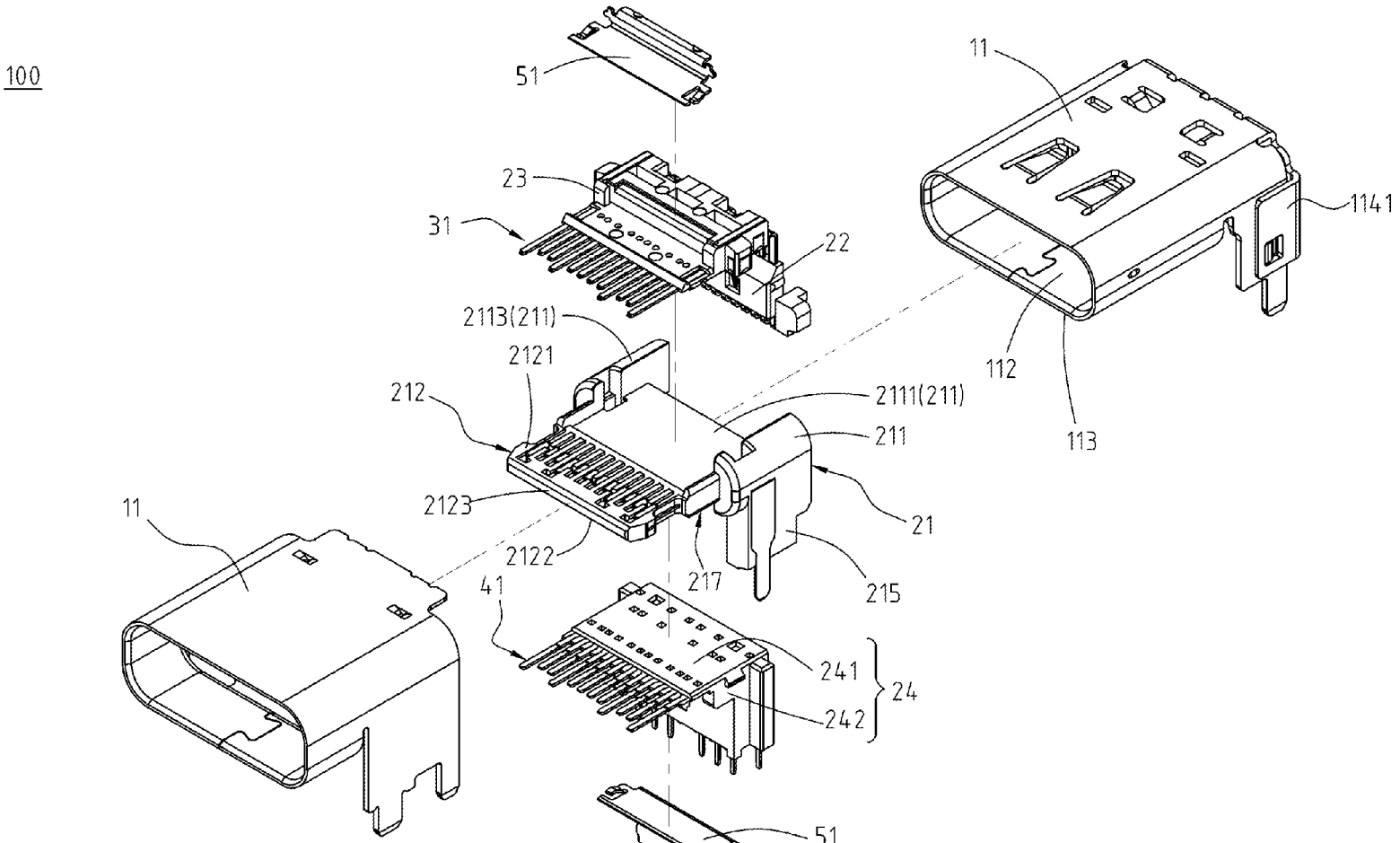
FIG. 2 illustrates an exploded view of the electrical receptacle connector.
Figure 3:
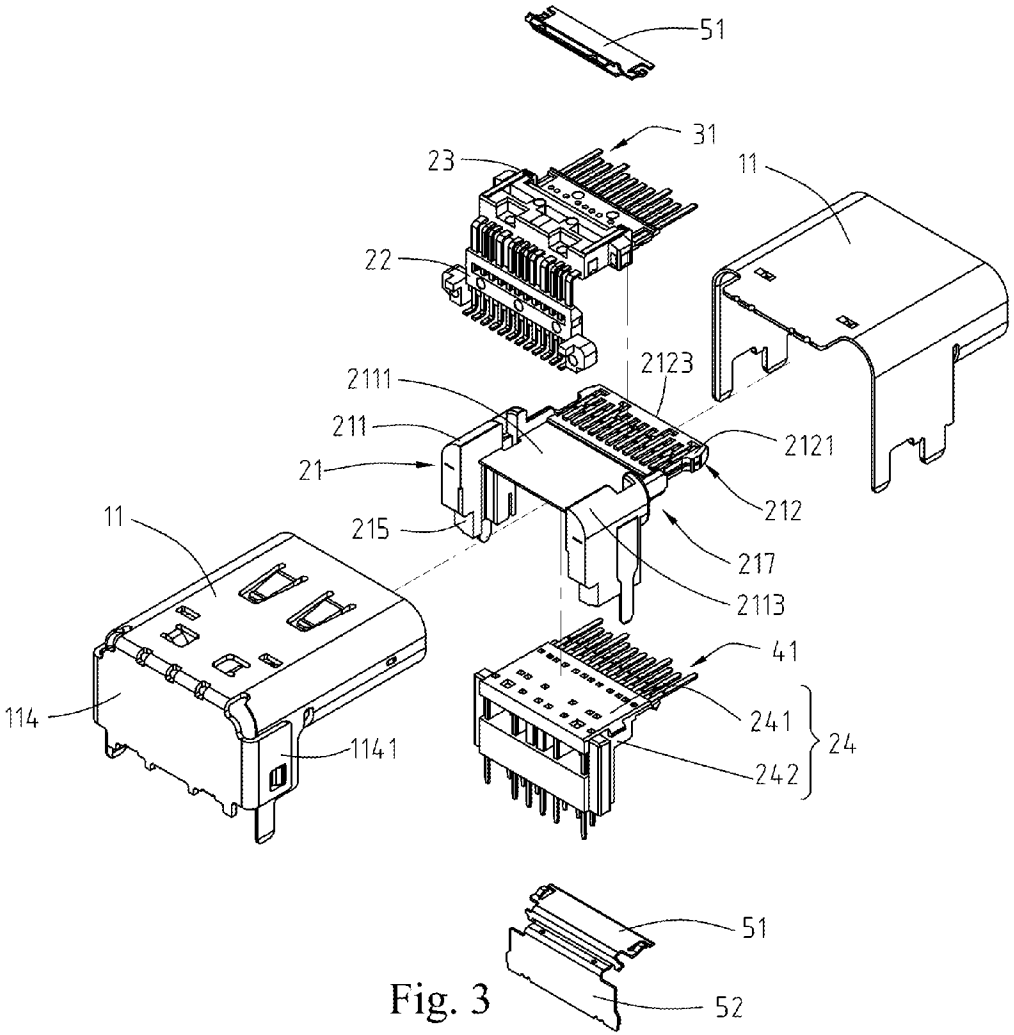
FIG. 3 illustrates an exploded view from the back of the electrical receptacle connector.

Please refer to FIGS. 1 to 3, which illustrate an electrical receptacle connector 100 of an exemplary embodiment of the instant disclosure. FIG. 1 illustrates a perspective view of an electrical receptacle connector 100. FIG. 2 illustrates an exploded view of the electrical receptacle connector 100. FIG. 3 illustrates an exploded view from the back of the electrical receptacle connector 100. In this embodiment, the electrical receptacle connector 100 is an elevated electrical receptacle connector and can provide a reversible or dual orientation USB Type-C connector interface and pin assignments, i.e., a USB Type-C receptacle connector. In this embodiment, the electrical receptacle connector 100 comprises a metallic shell 11, an insulated housing 21, a plurality of first receptacle terminals 31, a plurality of second receptacle terminals 41, and a terminal organizer 22.

The metallic shell 11 is a hollowed shell, and the metallic shell 11 defines a receiving cavity 112 therein. In this embodiment, the metallic shell 11 may be formed by a unitary member or a multi-piece member. In addition, an inserting opening 113 with oblong shaped is formed at one side of the metallic shell 11, and the inserting opening 113 communicates with the receiving cavity 112.

The insulated housing 21 is received in the receiving cavity 112 of the metallic shell 11. The insulated housing 21 comprises a base portion 211, a tongue portion 212, a plurality of extending portions 215, and an assembling region 217. In this embodiment, the base portion 211 and the tongue portion 212 may be made by injection molding, and a grounding plate is formed in the base portion 211 and the tongue portion 212. Moreover, the tongue portion 212 is extending from one side of the base portion 211. The tongue portion 212 has a first surface 2121 (i.e., the upper surface), a second surface 2122 (i.e., the lower surface), and a front lateral surface 2123. The extending portions 215 are extending outward (downward) from the bottom of the base portion 21 and respectively located at two sides of the base portion 211 to form sidearm structures. The region between the extending portions 215 is hollowed, and the region is defined as the assembling region 217. Because of the extended structure of the extending portions 215, the base portion 211 and the tongue portion 212 are elevated after a circuit board is assembled with the base portion 211 and the tongue portion 212. Hence, the base portion 211, the tongue portion 212, the metallic shell 11, the first receptacle terminals 31, and the second receptacle terminals 32 form an elevated electrical receptacle connector 100. Furthermore, the base portion 211 includes a plate section 2111 and two side walls 2113 at two sides of the plate portion 2111. The tongue portion 212 is extended from the plate section 2111. The extending portions 215 are extended from side walls 2113, respectively. In addition, each of the side walls 2113 has a height higher than the plate section 2111.

Please refer to FIGS. 4 to 7. The first receptacle terminals 31 comprise a plurality of first signal terminals 311, at least one power terminal 312, and at least one ground terminal 313. Referring to FIG. 6, the first receptacle terminals 31 comprise, from left to right, a ground terminal 313 (Gnd), a first pair of first signal terminals 3111 (TX1+−, differential signal terminals), a power terminal 312 (Power/VBUS), a first function detection terminal 3141 (CC1, a terminal for inserting orientation detection of the connector and for cable recognition), a second pair of first signal terminals 3112 (D+−, differential signal terminals), a supplement terminal 3142 (SBU1, a terminal can be reserved for other purposes), another power terminal 312 (Power/VBUS), a third pair of first signal terminals 3113 (RX2+−, differential signal terminals), and another ground terminal 313 (Gnd). In this embodiment, twelve first receptacle terminals 31 are provided for transmitting USB 3.0 signals. In some embodiments, the rightmost ground terminal 313 (Gnd) (or the leftmost ground terminal 313 (Gnd)) and the first supplement terminal 3142 (SBU1) can be omitted. Therefore, the total number of the first receptacle terminals 31 can be reduced from twelve terminals to seven terminals. Furthermore, the rightmost ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311.

In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 4 to 7. The first receptacle terminals 31 are held in the base portion 211 and the tongue portion 212. Each of the first receptacle terminals 31 comprises a flat contact portion 315, a body portion 317, and a tail portion 316. For each of the first receptacle terminals 31, the body portion 317 is held in the base portion 211 and the tongue portion 212, the flat contact portion 315 is extending forward from the body portion 317 in the rear-to-front direction and partly exposed upon the first surface 2121 of the tongue portion 212, and the tail portion 316 is extending backward from the body portion 317 in the front-to-rear direction and protruded from the base portion 211. The first signal terminals 311 are disposed at the first surface 2121 and transmit first signals (namely, USB 3.0 signals). The tail portions 316 are protruded from the bottom of the base portion 211. In addition, the tail portions 316 may be, but not limited to, bent horizontally to form flat legs, named SMT (surface mounted technology) legs, which can be mounted or soldered on the surface of a printed circuit board by using surface mount technology.

Please refer to FIGS. 4 to 7. The second receptacle terminals 41 comprise a plurality of second signal terminals 411, at least one power terminal 412, and at least one ground terminal 413. Referring to FIG. 6, the second receptacle terminals 41 comprise, from right to left, a ground terminal 413 (Gnd), a first pair of second signal terminals 4111 (TX2+−, differential signal terminals), a power terminal 412 (Power/VBUS), a second function detection terminal 4141 (CC2, a terminal for inserting orientation detection of the connector and for cable recognition), a second pair of second signal terminals 4112 (D+−, differential signal terminals), a supplement terminal 4142 (SBU2, a terminal can be reserved for other purposes), another power terminals 412 (Power/VBUS), a third pair of second signal terminals 4113 (RX1+1, differential signal terminals), and another ground terminal 413 (Gnd). In this embodiment, twelve second receptacle terminals 41 are provided for transmitting USB 3.0 signals. In some embodiments, the rightmost ground terminal 413 (or the leftmost ground terminal 413) and the second supplement terminal can be omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 4 to 7. The second receptacle terminals 41 are held in the base portion 211 and the tongue portion 212. Each of the second receptacle terminals 41 comprises a flat contact portion 415, a body portion 417, and a tail portion 416. For each of the second receptacle terminals 41, the body portion 417 is held in the base portion 211 and the tongue portion 212, the flat contact portion 415 is extending from the body portion 417 in the rear-to-front direction and partly exposed upon the second surface 2122 of the tongue portion 212, and the tail portion 416 is extending backward from the body portion 417 in the front-to-rear direction and protruded from the base portion 211. The second signal terminals 411 are disposed at the second surface 2122 and provided for transmitting second signals (i.e., USB 3.0 signals). The tail portions 416 are protruded from the bottom of the base portion 211. In addition, the tail portions 416 may be, but not limited to, bent horizontally to form flat legs, named SMT legs, which can be mounted or soldered on the surface of a printed circuit board by using surface mount technology. In some embodiments, the tail portions 416 are extending downwardly to form vertical legs, named through-hole legs, that are inserted into holes drilled in a printed circuit board by using through-hole technology.

Please refer to FIGS. 4 to 7. In this embodiment, the first receptacle terminals 31 and the second receptacle terminals 41 are respectively disposed at the first surface 2121 and the second surface 2122 of the tongue portion 212. Additionally, pin-assignments of the first receptacle terminals 31 and the second receptacle terminals 41 are point-symmetrical with a central point of the receiving cavity 112 as the symmetrical center. In other words, pin-assignments of the first receptacle terminals 31 and the second receptacle terminals 41 have 180 degree symmetrical design with respect to the central point of the receiving cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the standing-type electrical receptacle connector 100 with a first orientation where the first surface 2121 is facing up, for transmitting first signals. Conversely, the electrical plug connector is inserted into the electrical receptacle connector 100 with a second orientation where the first surface 2121 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Please refer to FIGS. 4 to 7. In this embodiment, the position of the first receptacle terminals 31 corresponds to the position of the second receptacle terminals 41.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Figure 10:
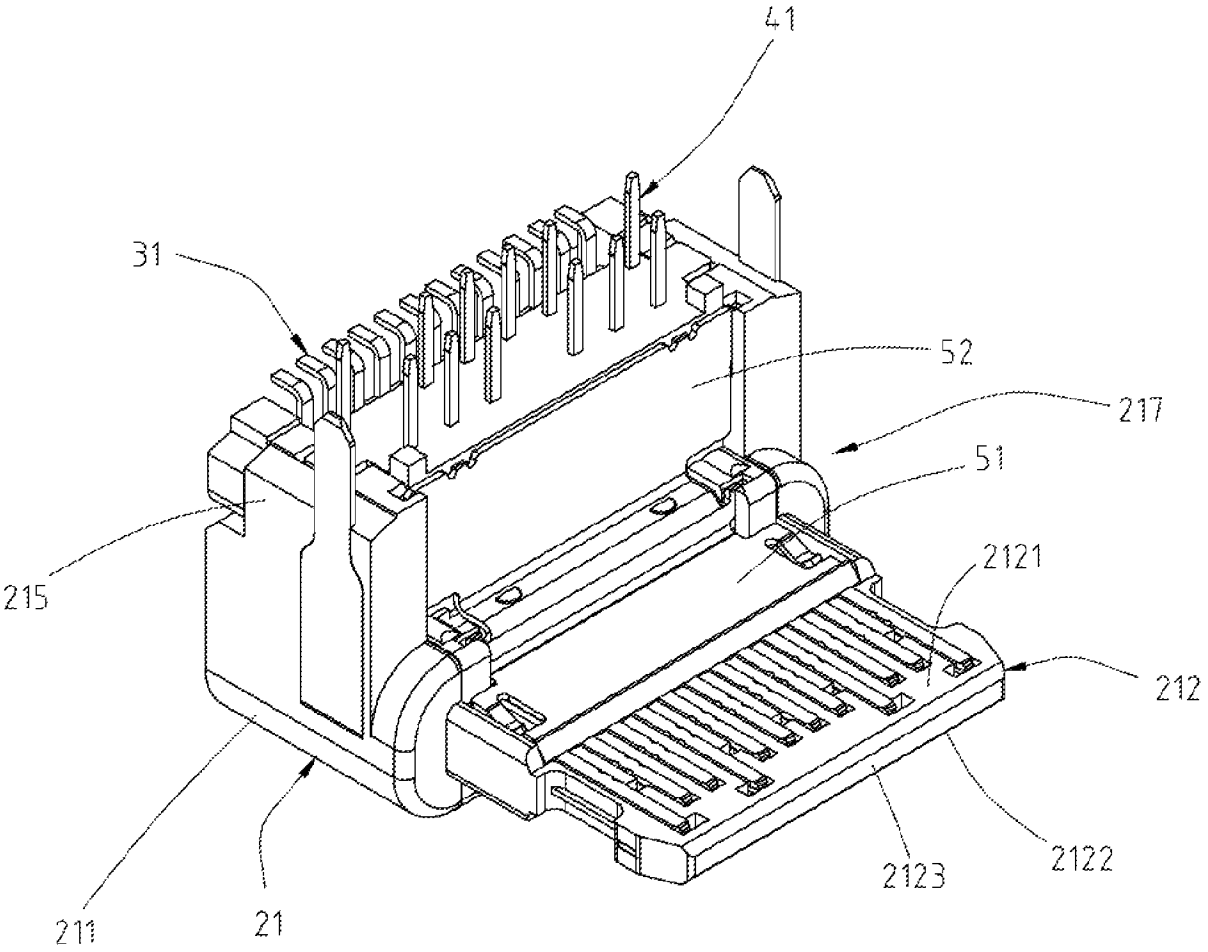
FIG. 10 illustrates a perspective view from the bottom of the electrical receptacle connector.

Please refer to FIG. 10. In this embodiment, the tail portions 316, 416 are protruded from the base portion 211 and arranged separately. The tail portions 316, 416 may be arranged into two parallel rows. Alternatively, the tail portions 416 may be aligned into two rows, and the first row of the tail portions 416 is aligned by an offset with respect to the second row of the tail portions 416; thus, the tail portions 316, 416 form three rows.

Figure 5:
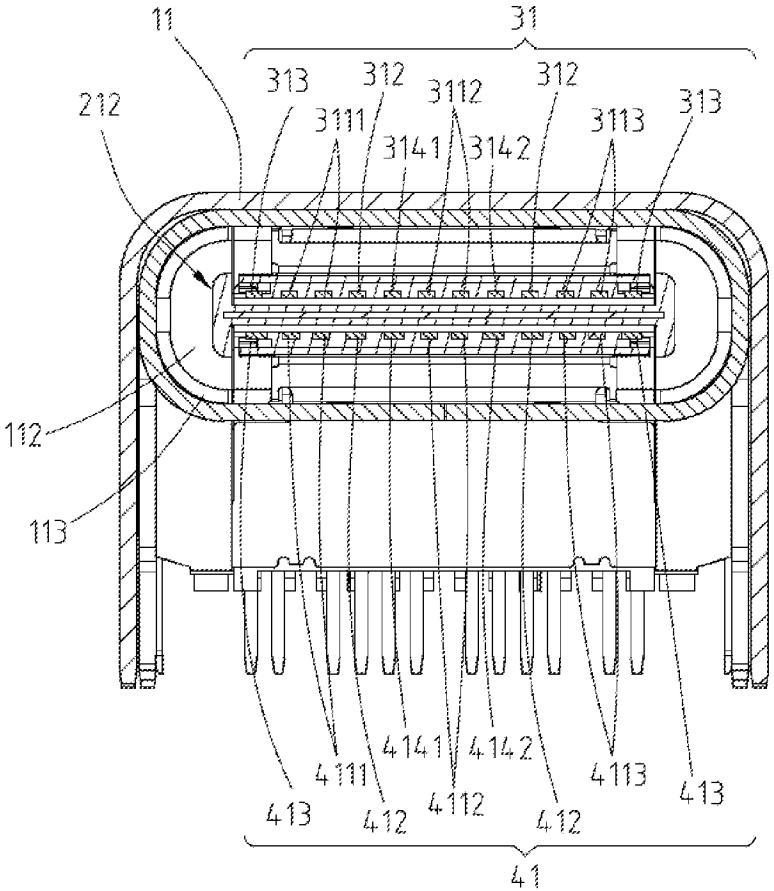
FIG. 5 illustrates a front sectional view of the electrical receptacle connector.
Figure 7:
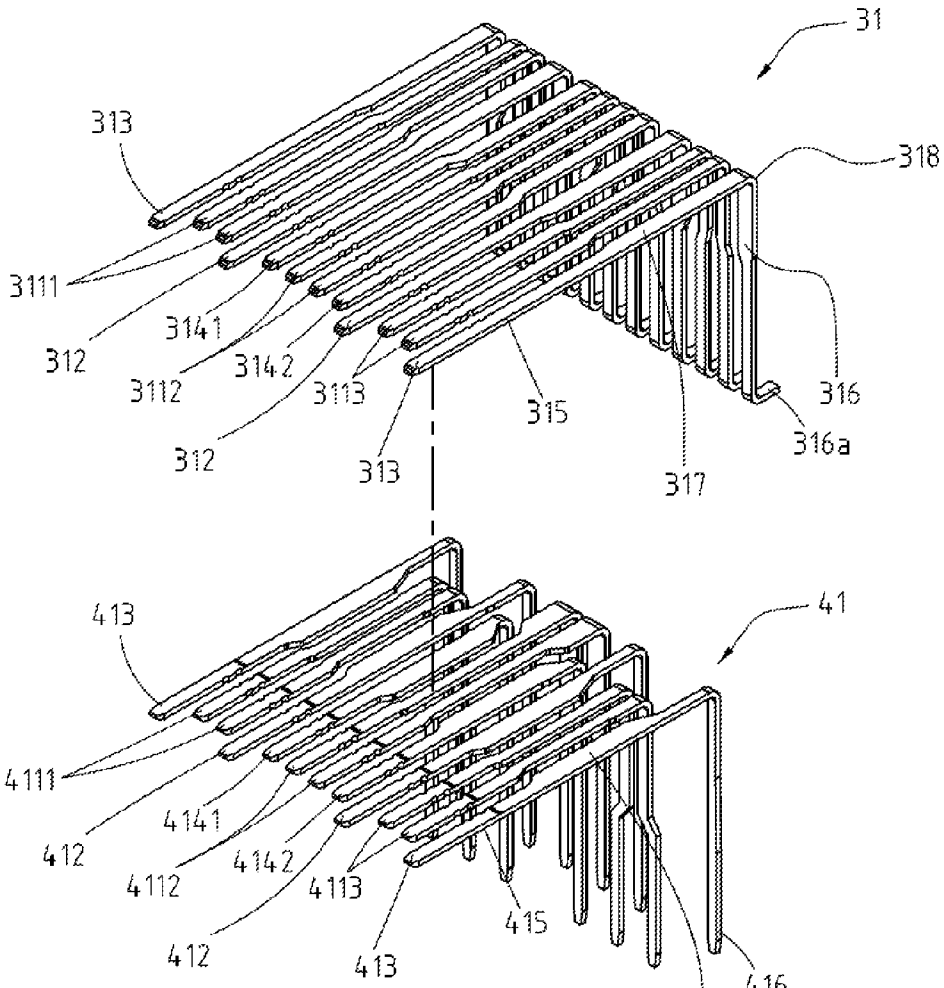
FIG. 7 illustrates a perspective view showing first receptacle terminals and second receptacle terminals of the electrical receptacle connector.

Please refer to FIG. 5. In this embodiment, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. In addition, the position of the tail portions 316 may correspond to the position of the tail portion 416. Alternatively, the tail portions 316 may be aligned by an offset with respect to the tail portions 416. Accordingly, the crosstalk between the first receptacle terminals 31 and the second receptacle terminals 41 can be reduced during signal transmission because of the offset alignment of the receptacle terminals 31, 41. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of first signal terminals 3111 (TX1+−) and the third pair of first signal terminals 3113 (RX2+−) are omitted, and the second pair of first signal terminals 3112 (D+−) 41 and the power terminals 312 (Power/VBUS) are retained. While for the second receptacle terminals 41 in accordance with transmission of USB 2.0 signals, the first pair of second signal terminals 4111 (TX2+−) and the third pair of second signal terminals 4113 (RX1+−) are omitted, and the second pair of second signal terminals 4112 (D+−) and the power terminals 412 (Power/VBUS) are retained.

Figure 4:
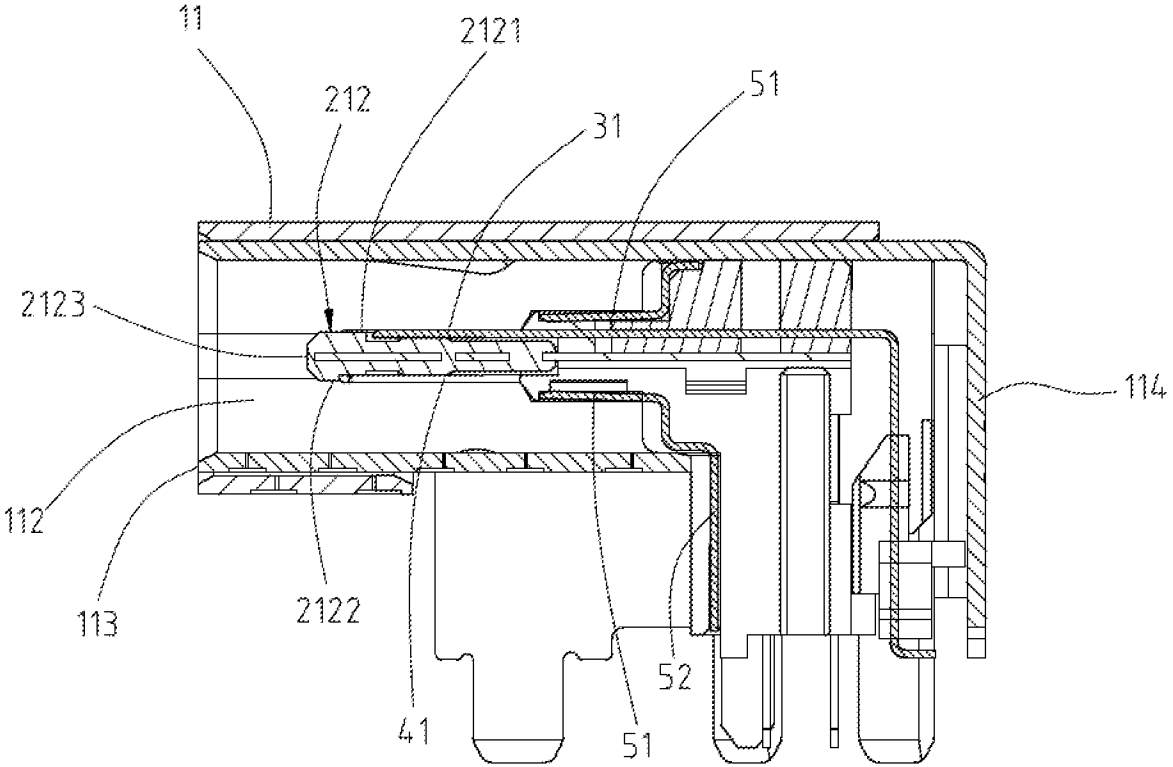
FIG. 4 illustrates a lateral sectional view of the electrical receptacle connector.

Please refer to FIGS. 2 and 4. It is noted that, the tail portion 316 is extending backward from the body portion 317 in the front-to-rear direction, and the tail portion 316 is bent and further extending toward the assembling region 217 of the insulated housing 21; similarly, the tail portion 416 is extending backward from the body portion 417 in the front-to-rear direction, and the tail portion 416 is bent and further extending toward the assembling region 217 of the insulated housing 21.

Figure 8:
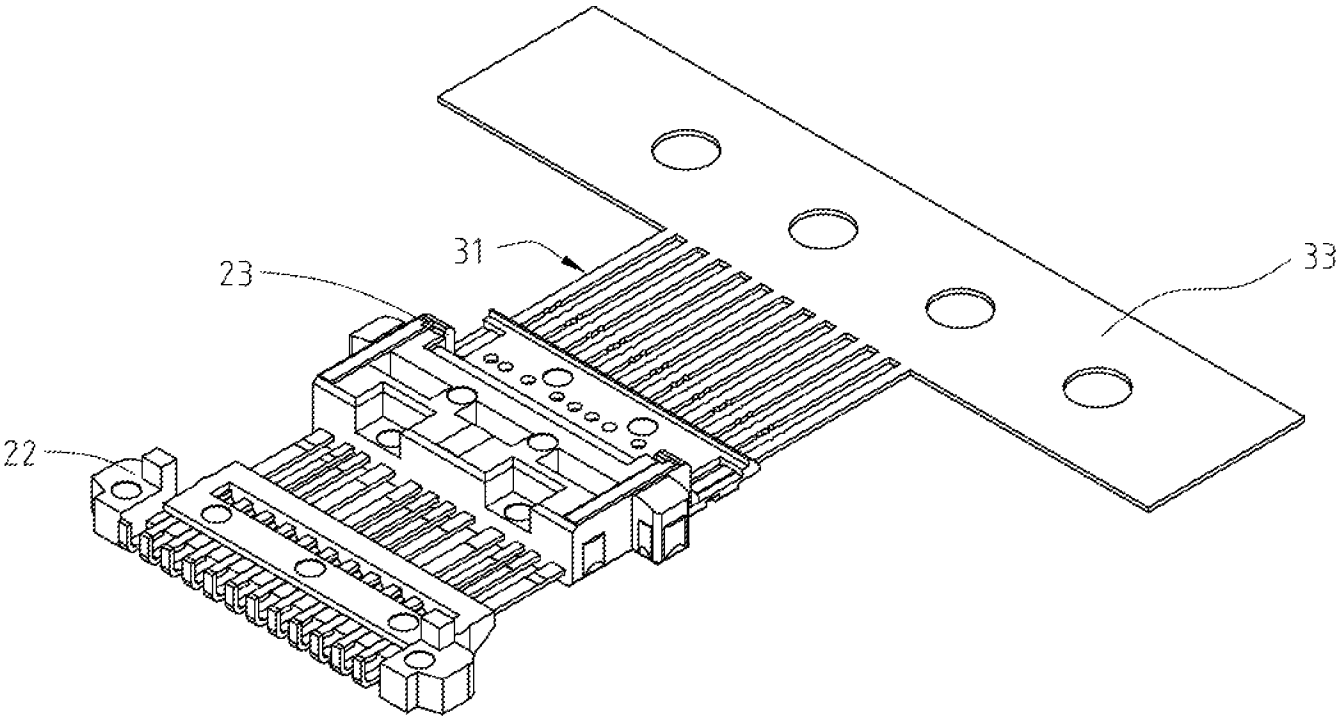
FIG. 8 illustrates a schematic perspective view of the first receptacle terminals formed integrally to a material band.

Please refer to FIGS. 3 and 8. The terminal organizer 22 is a rectangle-shaped plate. The terminal organizer 22 is formed with the tail portions 316. The terminal organizer 22 is located in the assembling region 217 and two sides of the terminal organizer 22 are positioned with the extending portions 215.

Please refer to FIGS. 2, 4, 7, and 8. The electrical receptacle connector 100 further comprises a first terminal fixing base 23 formed with the body portion 317. The first terminal fixing base 23 is assembled with the base portion 211 and the first surface 2121 of the tongue portion 212. In this embodiment, the first receptacle terminals 31 are extending with a terminal fixing plate 33 (i.e., a material band). The flat contact portion 315, the body portion 317, and an end portion 316*a* of the tail portion 316 of each of the first receptacle terminals 31 are aligned horizontally, and the first terminal fixing base 23 is assembled with the terminal organizer 22. Next, the terminal fixing plate 33 and the first receptacle terminals 31 are respectively assembled with the first terminal fixing base 23 and the terminal organizer 22 by applying insert-molding techniques twice in a mold. Then, the tail portions 316 are bent, so that the tail portion 316 and the body portion 317 of each of the first receptacle terminals 31 are substantially perpendicular to each other (i.e., in a lateral view, the first receptacle terminal 31 is of an inverse-L shape). Accordingly, the first receptacle terminals 31, the first terminal fixing base 23, and the terminal organizer 22 can be assembled with the insulated housing 21, and the terminal organizer 22 is positioned with the extended portions 215.

Figure 9:
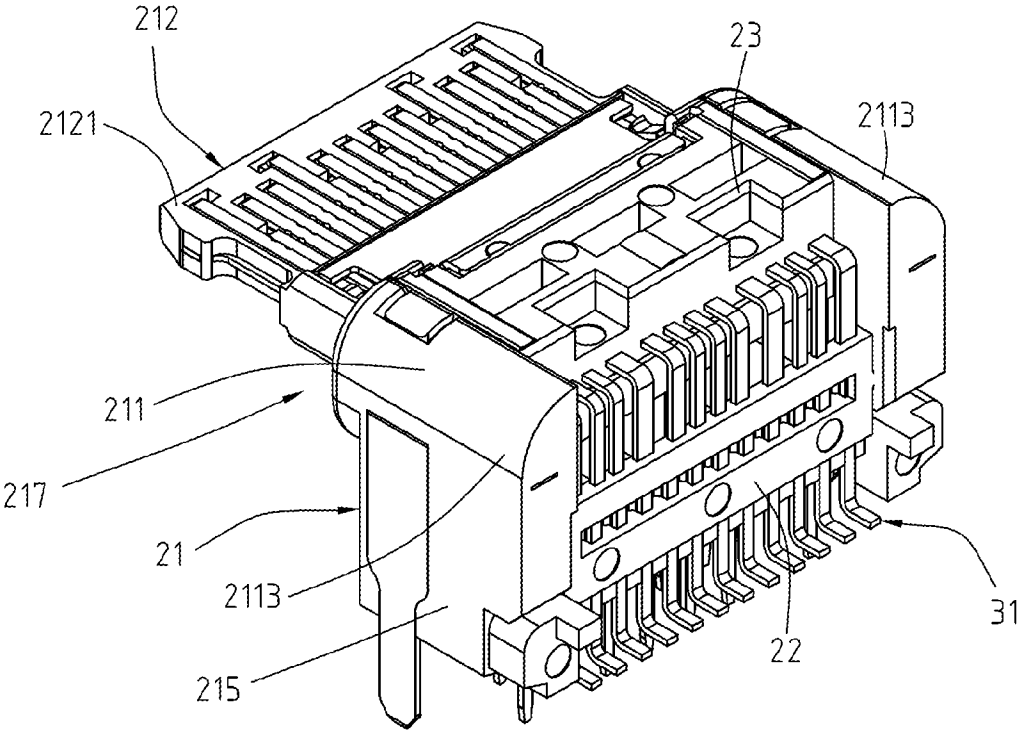
FIG. 9 illustrates a perspective view from the back of the electrical receptacle connector.

Please refer to FIGS. 2, 3 and 9. The first terminal fixing base 23 is on the plate section 2111 of the base portion 211 and between the two side walls 2113 of the base portion 211. The terminal organizer 22 is between the two extending portions 215.

Please refer to FIGS. 2, 4, 7, and 8. Initially, the first receptacle terminals 31 are bar shaped and integrally formed with the terminal fixing plate 33. Then, the terminal fixing plate 33 and the first receptacle terminals 31 are molded with the first terminal fixing base 23 and the terminal organizer 22 in the mold. According to embodiments of the instant disclosure, the electrical receptacle connector 100 is elevated, and the length of each of the first receptacle terminals 31 is longer than that of a conventional receptacle terminal. Hence, because of the bar shaped appearances of the first receptacle terminals 31, a mold fixture can be applied to fix the first receptacle terminals 31 in the mold easily for insert-molding during the insert-molding procedure. In addition, the first receptacle terminal 31 can be held in the base portion 211 and disposed at the first surface 2121 of the tongue portion 212 because of its longer length. The length of the tail portion 316 of each of the first receptacle terminals 31 is suitable to be soldered with contacts of a circuit board. Specifically, after each of the first receptacle terminals 31, of an inverse-L shaped, is held in the base portion 211 and the first surface 2121 of the tongue portion 212, and each of the second receptacle terminals 41, also of an inverse-L shaped, is held in the base portion 211 and the second surface 2122 of the tongue portion 212, the first receptacle terminals 31 are around the second receptacle terminals 41, and the length of each of the first receptacle terminals 31 is greater than the length of each of the second receptacle terminals 41.

Please refer to FIGS. 2, 3, 7, 9, and 10. After the first terminal fixing base 23 and the terminal organizer 22 are formed with the first receptacle terminals 31, a bending procedure is applied to bend the first receptacle terminals 31. When the first receptacle terminals 31 are bent, each of the first receptacle terminals 31 further comprises a turning portion 318 defined at the body portion 317 and between the first terminal fixing base 23 and the terminal organizer 22. In other words, the first terminal fixing base 23 and the terminal organizer 22 are both at the first receptacle terminals 31 while separated from each other. In addition, the first terminal fixing base 23 and the terminal organizer 22 are not at the turning portions 218 of the first receptacle terminals 31, so that after the first receptacle terminals 31 are assembled at the base portion 211, the first receptacle terminals 31 can be bent to form the turning portions 318 at the rear of the base portion 311.

Moreover, the assembling of the first receptacle terminals 31, the first terminal fixing base 23, and the terminal organizer 22 may be, but not limited to, as following description. In one embodiment, firstly, the first receptacle terminals 31 are provided, and the first terminal fixing base 23 is at the first receptacle terminals 31 and corresponds to the base portion 211 and the first surface 2121 of the tongue portion 212. Next, the tail portions 316 of the first receptacle terminals 31 are bent, so that the tail portion 316 and the body portion 317 of each of the first receptacle terminals 31 are substantially perpendicular with each other to form the turning portion 318. Hence, the two sides of the terminal organizer 22 are in contact with the inner walls of the two extending portions 215, and the terminal organizer 22 can be firmly assembled in the assembling region 217. In some embodiments, the first receptacle terminals 31, of inverse-L shaped, are assembled with the base portion 211 and the first surface 2121 of the tongue portion 212, so that the two sides of the terminal organizer 22 are in contact with the inner walls of the two extending portions 215.

In addition, because the terminal organizer 22 is formed at the tail portions 316 of the first receptacle terminals 31, the tail portions 316 of the first receptacle terminals 31 are positioned by the terminal organizer 22, and the distance between the tail portions 316 of the first receptacle terminals 31 can be fixed accordingly. Hence, the terminal organizer 22 can be provided for limiting and positioning the tail portions 316 of the first receptacle terminals 31.

In the foregoing embodiments, the terminal fixing plate 33 and the first receptacle terminals 31 are insert-molded twice with the first terminal fixing base 23 and the terminal organizer 22 in the mold, respectively, but embodiments are not limited thereto. In some embodiments, the procedure for assembling the first terminal fixing base 23 is omitted. In other words, the flat contact portions 315 of the first receptacle terminals 31 are directly assembled on the tongue portion 212 and do not assemble with the first terminal fixing base 23. Namely, the flat contact portions 315 of the first receptacle terminals 31 are directly insert-molded with the base portion 211 and the tongue portion 212, and the flat contact portions 315 of the first receptacle terminals 31 are held at the first surface 2121 of the tongue portion 212, and then the terminal organizer 22 is assembled between the extending portions 215. In this embodiment, the first receptacle terminals 31 are integrated with the terminal organizer 22 by single insert-molding, so that the manufacturing procedures and the assembling cost for the first terminal fixing base 23 can be saved.

Please refer to FIGS. 2 and 3. In some embodiments, the electrical receptacle connector 100 further comprises a grounding plate disposed in the insulated housing 21. The grounding plate comprises a body and a plurality of legs. The body is between the flat contact portions 315 of the first receptacle terminals 31 and the flat contact portions 415 of the second receptacle terminals 41. In other words, the body is held in the base portion 211 and the tongue portion 212 and between the flat contact portions 315, 415. In addition, the legs are extending downward from two sides of the body and extending out of the bottoms of the extending portions 215, and the legs are in contact with the contacts of the circuit board. Therefore, the crosstalk interference can be reduced by the grounding plate when the flat contact portions 315, 415 transmit signals. In addition, the structural strength of the tongue portion 212 can be improved by the assembly of the grounding plate. Moreover, the legs extending downward from the two sides of the body may be provided as through-hole legs, and the legs are exposed from the base portion 211 to be in contact with the circuit board. In some embodiments, the legs may be extending downward from the rear of the body and provided as through-hole legs, and the legs are exposed from the base portion 211 to be in contact with the circuit board. Furthermore, the grounding plate comprises a plurality of hooks protruded from two sides of the tongue portion 212. When an electrical plug connector is mated with the electrical receptacle connector 100, elastic pieces at two sides of an insulated housing of the electrical plug are engaged with the hooks, and the elastic pieces would not wear against the tongue portion 212 of the electrical receptacle connector 100. Additionally, the electrical plug connector may further comprise a plurality of protruded abutting portions, and the protruded abutting portions are in contact with the metallic shell 11 of the electrical receptacle connector 100. Hence, the elastic pieces and the protruded abutting portions are provided for conduction and grounding.

Please refer to FIGS. 2 to 4. In this embodiment, the electrical receptacle connector 100 further comprises a second terminal fixing base 24. The second terminal fixing base 24 is formed with the second receptacle terminals 41. The second terminal fixing base 24 is assembled at the assembling region 217 between the extending portions 215, and two sides of the second terminal fixing base 24 are positioned with the extending portions 215. In addition, the second terminal fixing base 24 comprises a main body portion 241 and an extending body portion 242. The main body portion 241 is held on the base portion 211 and the second surface 2122 of the tongue portion 212. The extending body portion 242 is extending outward from the bottom of the main body portion 241 to cover the tail portions 416 of the second receptacle terminals 41. From a lateral view, the main body portion 241 and the extending body portion 242 are of inverse-L shaped.

Please refer to FIGS. 2 to 4 and FIG. 10. In this embodiment, the electrical receptacle connector 100 further comprises a plurality of conductive sheets 51 and a shielding sheet 52. The conductive sheets 51 are metal elongated plates and may comprise an upper conductive sheet 51 and a lower conductive sheet 51. The upper conductive sheet 51 is assembled on the first terminal fixing base 23, and the lower conductive sheet 51 is assembled on the second terminal fixing base 24. Specifically, the lower conductive sheet 51 is assembled on the bottom of the main body portion 241 of the second terminal fixing base 24. The shielding sheet 52 is extending from the bottom of the lower conductive sheet 51 to cover the front lateral surface of the extending body portion 242. In addition, the shielding sheet 52 may be formed integrally with one of the conductive sheets 51; alternatively, the shielding sheet 52 and the conductive sheet 51 may be separated members. Hence, when an electrical plug connector is mated with the electrical receptacle connector 100, the front of a metallic shell of the electrical plug connector is in contact with the conductive sheets 51, the metallic shell of the electrical plug connector is efficiently in contact with the metallic shell 11 of the electrical receptacle connector 100 via the conductive sheets 51, and the electromagnetic interference problem can be improved. In addition, because the shielding sheet 52 covers the front lateral surface of the extending body portion 242, the high frequency performance of the tail portions 416 of the second receptacle terminals 41 in the extending body portion 242 can be enhanced by the shielding sheet 52.

Figure 11:
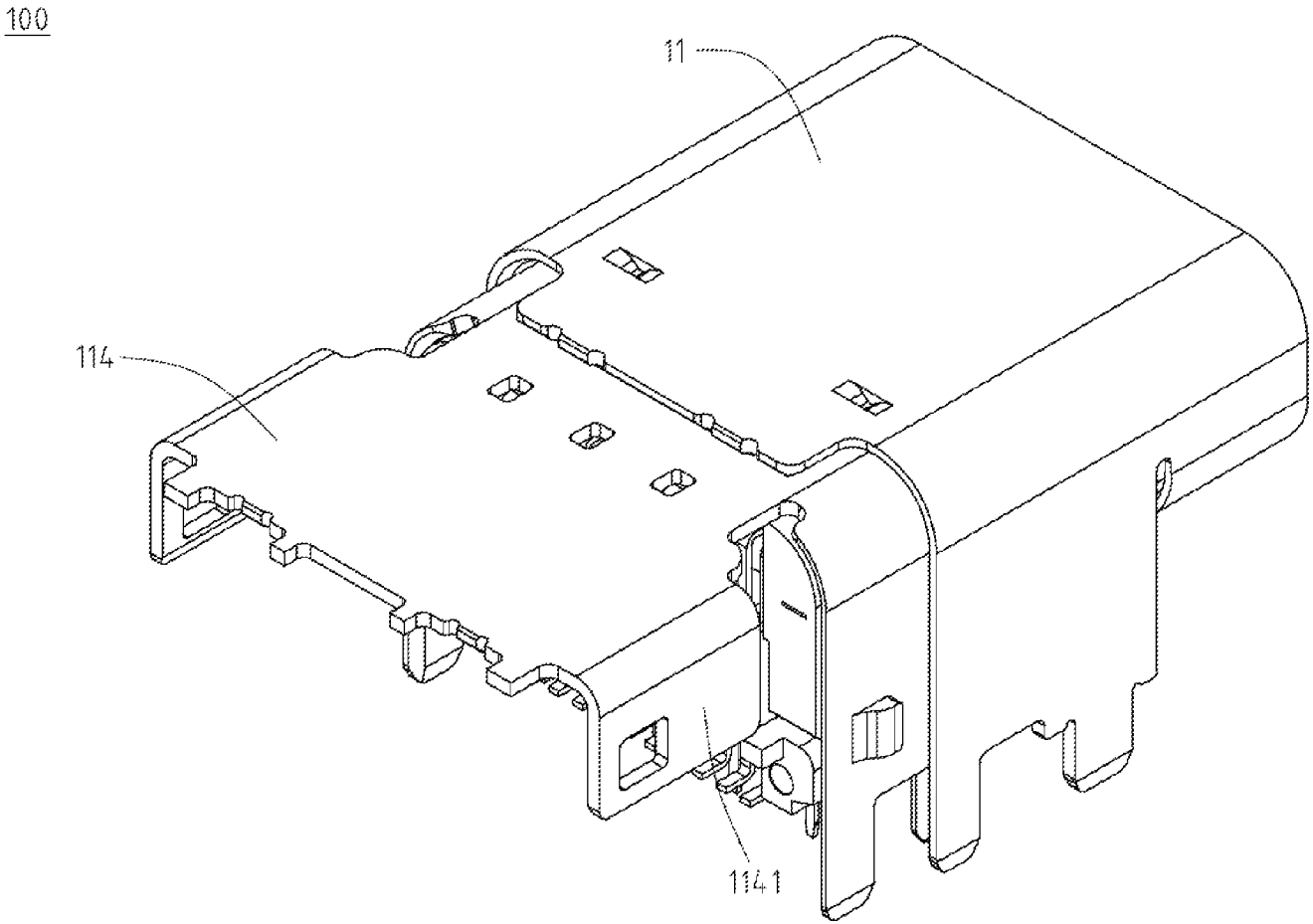
FIG. 11 illustrates a perspective view of the electrical receptacle connector in which the rear cover plate is in an opened state.

Please refer to FIGS. 3, 4, and 11. The metallic shell 11 further comprises a rear cover plate 114 extending therefrom to cover the rear of the receiving cavity 112 and the tail portions 316 of the first receptacle terminals 31. The exposed area of the tail portions 316 of the first receptacle terminals 31 can be reduced because the rear cover plate 114 is covered at the rear of the receiving cavity 112. The rear cover plate 114 provides a shielding function and prevents interference signals from spreading outside. Specifically, the two sides of the rear cover plate 114 comprise fixing sheets 1141. When the electrical receptacle connector 100 is soldered with a circuit board, the contacts of the circuit board and the tail portions 316 of the first receptacle terminals 31 are covered by solder spots, and the rear cover plate 114 is in an opened state to allow an operator to check if the tail portions 316 of the first receptacle terminals 31 are firmly in contact with the contacts of the circuit board and if the solder spots are separated from each other to avoid short circuit (as shown in FIG. 11). When the tail portions 316 of the first receptacle terminals 31 are firmly in contact with the contacts of the circuit board, the rear cover plate 114 is closed to shield the rear of the receiving cavity 112, and the fixing sheets 1141 at two sides of the rear cover plate 114 are firmly engaged with two sides of the metallic shell 11. The rear cover plate 114 allows the operator to check if the tail portions 316 of the first receptacle terminals 31 are firmly soldered with the contacts of the circuit board. Once the soldering fails, the operator can redo the soldering procedure.

Based on the above, an elevated electrical receptacle connector is provided. The length of each of the first receptacle terminals is longer than that of a conventional receptacle terminal. Hence, because of the bar shaped appearances of the first receptacle terminals, the first receptacle terminals are firstly formed with the terminal organizer, and then the first receptacle terminals and the terminal organizer are assembled on the base portion and the tongue portion. Accordingly, the first receptacle terminals can be positioned and protected by the terminal organizer, and the longer length of each of the first receptacle terminals would not affect the insert-molding procedure.

In addition, the terminal organizer can position the tail portions of the first receptacle terminals. Hence, when a bending procedure is applied to the first receptacle terminals, the first receptacle terminals can be bent conveniently. Therefore, the angle defined by the flat contact portion and the tail portion of the first receptacle terminal can be adjusted to allow the first receptacle terminal to be firmly soldered with the circuit board. Moreover, the terminal organizer also improves the accessibility in bending the tail portions of the first receptacle terminals.

Furthermore, the extending body portion of the second terminal fixing base covers the tail portions of the second receptacle terminals, and the shielding sheet covers the front lateral surface of the extending body portion. Hence, the high frequency performance of the tail portions of the second receptacle terminals in the extending body portion can be enhanced by the shielding sheet. In addition, the openable and closeable rear cover plate allows the operator to check if the tail portions of the first receptacle terminals are firmly soldered with the contacts of the circuit board, and the rear cover plate can be closed after the soldering condition between the first receptacle terminals and the circuit board is checked. Once the soldering fails, the operator can redo the soldering procedure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell defining a receiving cavity therein;

an insulated housing received in the receiving cavity, wherein the insulated housing comprises a base portion, a tongue portion, a plurality of extending portions, and an assembling region, wherein the base portion comprises a plate section and two side walls at two sides of the plate section, each of the side wall has a height higher than the plate section, the tongue portion is extending from one side of the base portion, the tongue portion has a first surface and a second surface, and the first surface is opposite to the second surface, the extending portions are extending outward from the bottom of the side walls of the base portion, and the assembling region is defined between the extending portions;

a plurality of first receptacle terminals comprising a plurality of first signal terminals, at least one power terminal, and at least one ground terminal, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction, and the tail portion is bent and further extending toward the assembling region;

a plurality of second receptacle terminals comprising a plurality of second signal terminals, at least one power terminal, and at least one ground terminal, wherein each of the second receptacle terminals is held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction, and the tail portion is bent and further extending toward the assembling region; and a terminal organizer formed with the tail portions of the first receptacle terminals, wherein the terminal organizer is located in the assembling region and between the extending portion, and two sides of the terminal organizer are positioned with the extending portions;

a first terminal fixing base formed with the body portions of the first receptacle terminals, wherein the first terminal fixing base is assembled with the base portion and between the sides walls of the base portion, and on plate section and the first surface of the tongue portion;

a second terminal fixing base formed with the second receptacle terminals, wherein the second terminal fixing base is assembled at the assembling region and two sides of the second terminal fixing base are positioned with the extending portions, wherein the second terminal fixing base comprises a main body portion and an extending body portion, the main body portion is held on the base portion and the second surface of the tongue portion, and the extending body portion is extending outward from the bottom of the main body portion to cover the tail portions of the second receptacle terminals;

a conductive sheet located at the bottom of the main body portion; and a shielding sheet extending from the bottom of the conductive sheet to cover the front lateral surface of the extending body portion.

2. The electrical receptacle connector according to claim 1, wherein the first receptacle terminals further comprise a plurality of turning portions, each of the turning portions is at the corresponding body portion of the first receptacle terminal, and each of the turning portions is between the first terminal fixing base and the terminal organizer.

3. The electrical receptacle connector according to claim 1, wherein the flat contact portion, the body portion, and an end portion of the tail portion of each of the first receptacle terminals are aligned along a horizontal line, and the first terminal fixing base is assembled with the terminal organizer.

4. The electrical receptacle connector according to claim 1, wherein the tail portion and the body portion of the each of the first receptacle terminals are substantially perpendicular to each other, so that the terminal organizer is positioned with the extending portions.

5. The electrical receptacle connector according to claim 1, wherein the metallic shell comprises a rear cover plate covering the rear of the receiving cavity and the tail portions of the first receptacle terminals.

6. The electrical receptacle connector according to claim 1, wherein the first receptacle terminals and the second receptacle terminals have 180 degree symmetrical design with respect to a central point of the receiving cavity as the symmetrical center, and the position of the first receptacle terminals corresponds to the position of the second receptacle terminals.

7. An electrical receptacle connector, comprising:

a metallic shell defining a receiving cavity therein;

an insulated housing received in the receiving cavity, wherein the insulated housing comprises a base portion, a tongue portion, a plurality of extending portions, and an assembling region, wherein the base portion comprises a plate section and two side walls at two sides of the plate section, each of the side wall has a height higher than the plate section, the tongue portion is extending from one side of the plate section of the base portion, the tongue portion has a first surface and a second surface, and the first surface is opposite to the second surface, the extending portions are extending outward from the bottom of the side walls of the base portion, and the assembling region is defined between the extending portions;

a plurality of first receptacle terminals held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction, and the tail portion is bent and further extending toward the assembling region;

a plurality of second receptacle terminals held in the insulated housing and disposed at the second surface, wherein each of the second receptacle terminals comprises a flat contact portion, a body portion, and a tail portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction, and the tail portion is bent and further extending toward the assembling region;

a terminal organizer formed with the tail portions of the first receptacle terminals, wherein the terminal organizer is located at the assembling region and between the extending portion, and two sides of the terminal organizer are positioned with the extending portions;

a first terminal fixing base formed with the body portions of the first receptacle terminals, wherein the first terminal fixing base is assembled with the base portion and between the sides walls of the base portion, and on plate section and the first surface of the tongue portion;

a second terminal fixing base formed with the second receptacle terminals, wherein the second terminal fixing base is assembled at the assembling region and two sides of the second terminal fixing base are positioned with the extending portions, wherein the second terminal fixing base comprises a main body portion and an extending body portion, the main body portion is held on the base portion and the second surface of the tongue portion, and the extending body portion is extending outward from the bottom of the main body portion to cover the tail portions of the second receptacle terminals;

a conductive sheet located at the bottom of the main body portion; and a shielding sheet extending from the bottom of the conductive sheet to cover the front lateral surface of the extending body portion.

8. The electrical receptacle connector according to claim 7, wherein the first receptacle terminals further comprise a plurality of turning portions, each of the turning portions is at the corresponding body portion of the first receptacle terminal, and each of the turning portions is between the first terminal fixing base and the terminal organizer.

9. The electrical receptacle connector according to claim 7, wherein the flat contact portion, the body portion, and an end portion of the tail portion of each of the first receptacle terminals are aligned along a horizontal line, and the first terminal fixing base is assembled with the terminal organizer.

10. The electrical receptacle connector according to claim 7, wherein the tail portion and the body portion of the each of the first receptacle terminals are substantially perpendicular to each other, so that the terminal organizer is positioned with the extending portions.

11. The electrical receptacle connector according to claim 7, wherein the metallic shell comprises a rear cover plate covering the rear of the receiving cavity and the tail portions of the first receptacle terminals.

12. The electrical receptacle connector according to claim 7, wherein the first receptacle terminals and the second receptacle terminals have 180 degree symmetrical design with respect to a central point of the receiving cavity as the symmetrical center, and the position of the first receptacle terminals corresponds to the position of the second receptacle terminals.

* * * * *